US005462202A

United States Patent [19]

Haffner et al.

[11] Patent Number: 5,462,202

[45] Date of Patent: Oct. 31, 1995

[54] LIQUID CONTAINING AND DISPENSING PACKAGE

[75] Inventors: Eugene F. Haffner, Maumee; Luz Rios, Oak Harbor, both of Ohio

[73] Assignee: Owens-Illinois Closure Inc., Toledo, Ohio

[21] Appl. No.: 295,964

[22] Filed: Aug. 25, 1994

[51] Int. Cl.[6] ..... B67D 1/16

[52] U.S. Cl. ..... 222/109; 222/571

[58] Field of Search ..... 222/109, 108, 222/111, 481, 566, 571; 215/100 R

[56] References Cited

U.S. PATENT DOCUMENTS

| | | | |
|---|---|---|---|
| 3,217,935 | 11/1965 | Burt . | |
| 3,300,104 | 1/1967 | Burt . | |
| 3,833,150 | 9/1974 | Visser-Patings . | |
| 4,078,700 | 3/1978 | Hidding . | |
| 4,298,145 | 11/1981 | Iida . | |
| 4,427,138 | 1/1984 | Heinlein . | |
| 4,550,862 | 11/1985 | Barker . | |
| 4,706,829 | 11/1987 | Li . | |
| 4,756,433 | 7/1988 | Lin . | |
| 4,773,560 | 9/1988 | Kittscher | 222/109 |
| 4,890,770 | 1/1990 | Haga . | |
| 4,917,268 | 4/1990 | Campbell . | |
| 5,020,692 | 6/1991 | Darr . | |
| 5,058,772 | 10/1991 | Moore . | |

*Primary Examiner*—Gregory L. Huson

[57] ABSTRACT

A liquid dispensing fitment for use on a container having a neck comprises a plastic body which has an inner wall defining an axial spout extending from within the neck of a container and axially beyond the end of the neck. The body has an outer annular wall spaced from the spout and connected to the spout by an integral annular connecting portion. The spout extends axially beyond the outer wall and has an upper generally C-shaped cross section defining an opening and a lower annular cross section. The annular connecting portion is inclined with respect to the axis of the spout and has its lowermost portion aligned with the opening of said C-shaped portion of said spout. The outer wall has an axial opening extending from a position aligned with the juncture of the C-shaped portion and annular portion of the spout through the annular connecting portion to define a combined drain back opening and a near empty pour out hole. The fitment is provided with means on the upper end of the outer wall for engaging the neck of the container. The lower portion of the spout is substantially smooth in an axial direction to facilitate drain back. The lower portion of the spout has an inner surface formed with an integral axial rib aligned with the axial opening in the outer wall to facilitate manufacture. The wall of the fitment is provided with an axially extending opening that extends from a position aligned with the junction of the C-shaped portion and annular portion to define a combined drain back opening and near empty pour out hole.

6 Claims, 3 Drawing Sheets

LIQUID CONTAINING AND DISPENSING PACKAGE

This invention relates to liquid containing and dispensing packages and particularly to such packages which include a pouring spout and a closure that functions as a measuring cup.

BACKGROUND AND SUMMARY OF THE INVENTION

In one type of liquid dispensing package, a pouring spout fitment is positioned on the neck of the container and a closure in the form of the cup is interengaged with the periphery of the container. More specifically, a spout is mounted in a first fitment that is on a container. The fitment has internal threads which are engaged by the external threads of a cover.

In U.S. Pat. No. 4,706,829, there is disclosed a liquid containing and dispensing package comprising a hollow plastic container having a neck, a fitment interengaging the neck and a closure. The fitment interengages the neck and as a first peripheral portion extending axially and having a portion defining a spout having a pouring lip extending axially inwardly of the end of the neck, and a closure comprising a top wall and a first peripheral wall extending from the top wall axially inwardly. The closure includes a radial portion extending from the peripheral wall and sealingly engaging an annular area of the fitment. The closure defines a dispensing cup and includes a second outer peripheral wall spaced from the first peripheral wall which has internal threads engaging external threads on the neck of the container.

Among the objectives of the present invention are to provide a liquid containing package wherein the spout fitment or insert has improved mold ability in larger size spouts; which requires less complicated tooling such that is easier to mold.

In accordance with the invention, a liquid dispensing fitment for use on a container having a neck comprises a plastic body which has an inner wall defining an axial spout extending from within the neck of a container and axially beyond the end of the neck. The body has an outer annular wall spaced from the spout and connected to the spout by an integral annular connecting portion. The spout extends axially beyond the outer wall and has an upper generally C-shaped cross section defining an opening and a lower annular cross section. The annular connecting portion is inclined with respect to the axis of the spout and has its lowermost portion aligned with the opening of said C-shaped portion of said spout. The outer wall has an axial opening extending from a position aligned with the juncture of the C-shaped portion and annular portion of the spout through the annular connecting portion to define a combined drain back opening and a near empty pour out hole. The fitment is provided with means on the upper end of the outer wall for engaging the neck of a container. The lower portion of the spout is substantially smooth in an axial direction to facilitate drain back. The lower portion of the spout has an inner surface formed with an integral axial rib aligned with the axial opening in the outer wall to facilitate manufacture. The wall of the fitment is provided with an axially extending opening that extends from a position aligned with the junction of the C-shaped portion and annular portion to define a combined drain back opening and near empty pour out hole.

DESCRIPTION OF THE PREFERRED EMBODIMENTS

Figure 1:
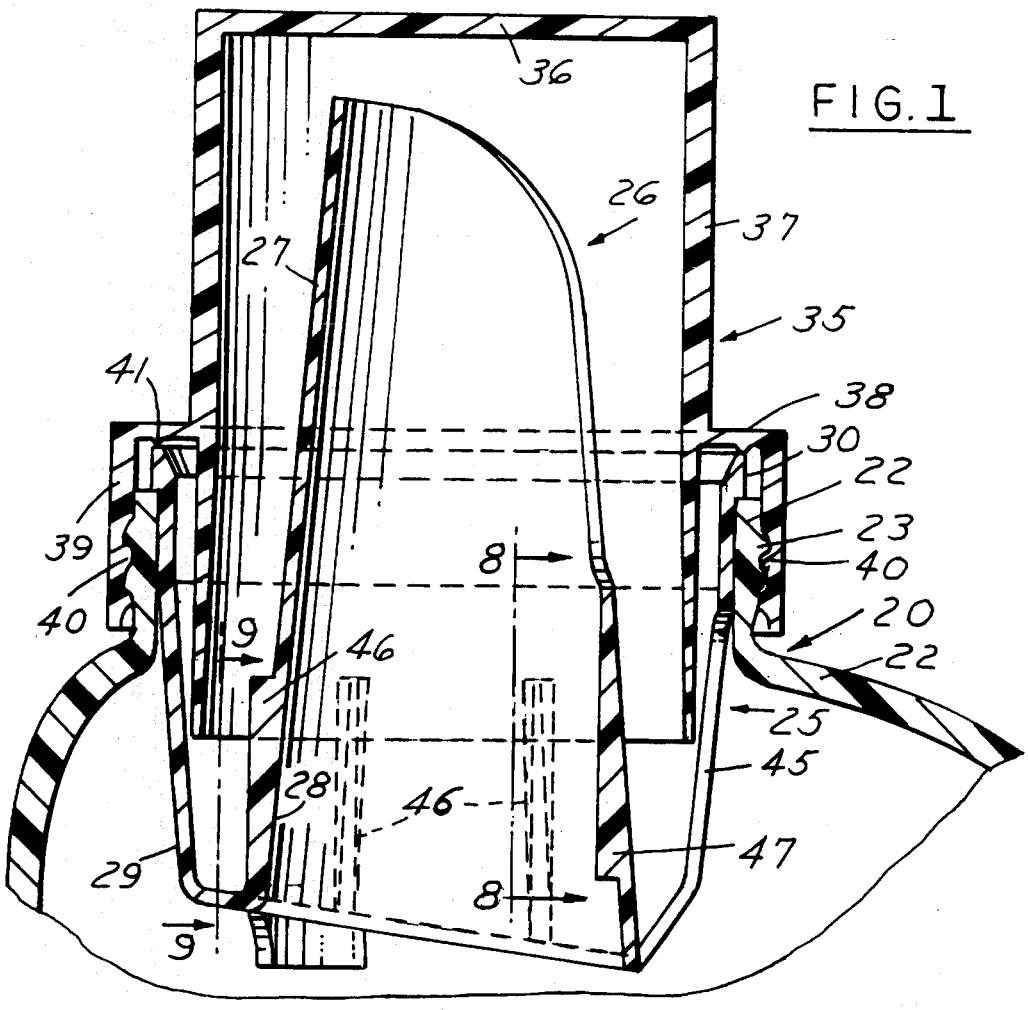
FIG. 1 is a sectional view of a liquid containing and dispensing package embodying the invention.

In accordance with the invention, the container package 20 comprises a hollow plastic container 21 having a body 22 and a neck 23. The neck 23 is formed with external threads 23. The package 20 further includes a fitment or insert 25 that comprises a centrally disposed inner spout portion 26 that has an arcuate upper portion 27 which is generally C-shaped in transverse cross-section. The spout 26 has an annular lower portion 28. The fitment 25 further includes an outer wall portion 29 interconnected by an annular portion 18 and extending generally upwardly and outwardly. The outer wall portion 29 further includes a peripheral flange 30 adapted to engage the upper surface of the neck 22.

The package 20 further includes a closure 35 that is generally cylindrical including a top wall 36 and a peripheral wall 37. The peripheral wall 37 extends downwardly within the walls of the spout 26. The cap 35 further includes an annular wall 38 extending radially outwardly intermediate the ends of the peripheral wall 37 and an annular axial skirt 39 extending downwardly and having internal threads 40 engaging the external threads 23 on the neck 32.

The wall 38 of the closure includes an annular downwardly extending annular projection in the form of a bead 41, preferably having a V cross-section, that engages the fitment 25 to provide a primary seal between the closure 35 and the fitment 25 and, in turn, force the fitment 25 against the end of the neck 22.

The container 21 may be made of plastic material such as high density polyethylene. The fitment 25 may be made of other plastic materials, for example, low density polyethylene. The closure 35 may be made of plastic material such as polypropylene.

The wall of the fitment is provided with an axially extending opening or slot 45 that extends from a position aligned with the junction of the C-shaped portion and annular portion to define a combined drain back opening and near empty pour out hole.

Unlike earlier pour spouts or fitments 25, where the drain and near empty holes are separate, this spout or fitment 25 has one continuous, uninterrupted slot, which is a combination of the earlier drain and near empty holes. By combining these two individual features into one, the tooling used to manufacture the spout is simplified, and the component is easier to produce as well.

The drain back and near-empty holes remain separate, but by including a chamfer or recess at the base of the near-empty hole, the design will allow the tooling to also be simplified, as there would be only positive taper surfaces in the direction of draw.

Figure 5:
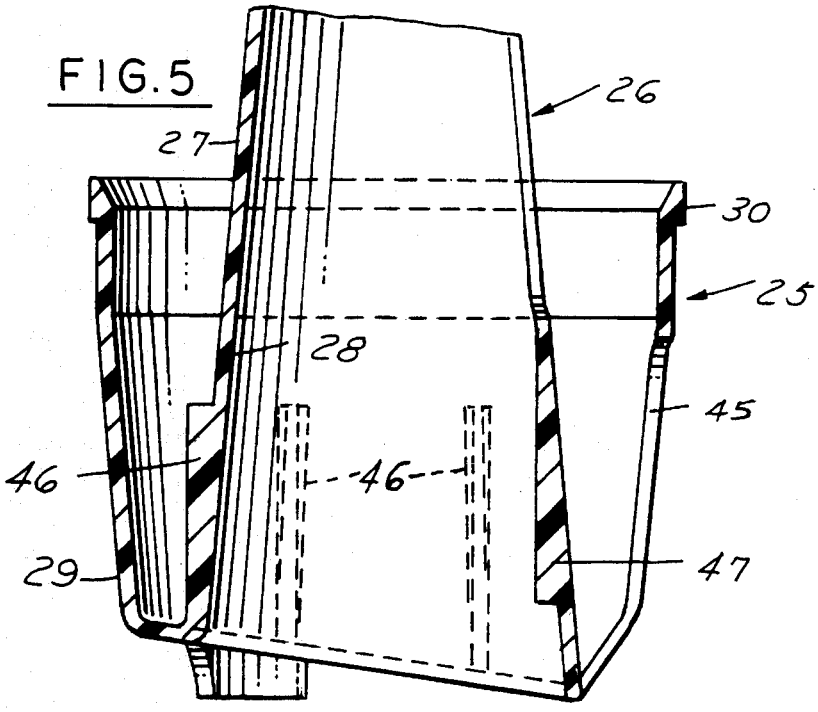
FIG. 5 is a fragmentary sectional view taken along the line 5'—5 in FIG. 3.
Figure 3:
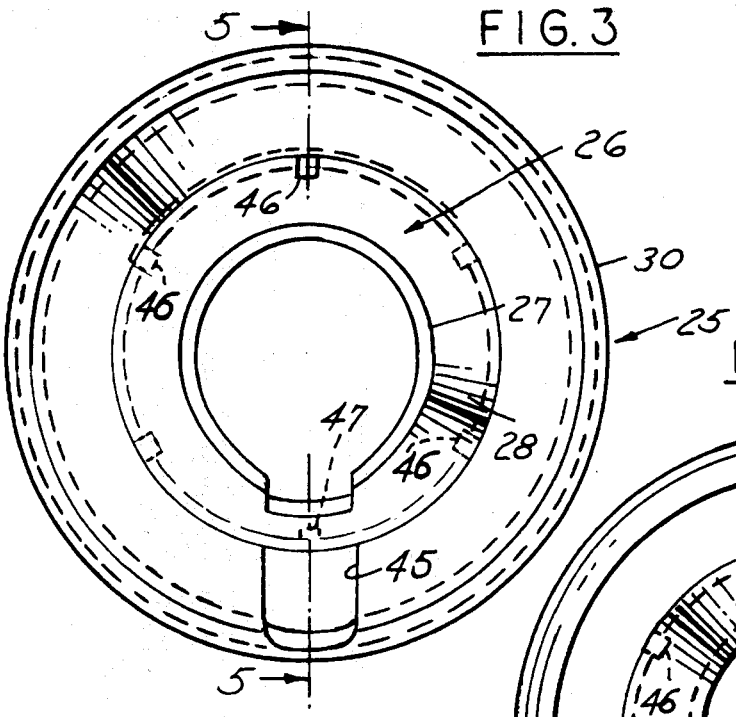
FIG. 3 is a top plan view of the fitment.
Figure 2:
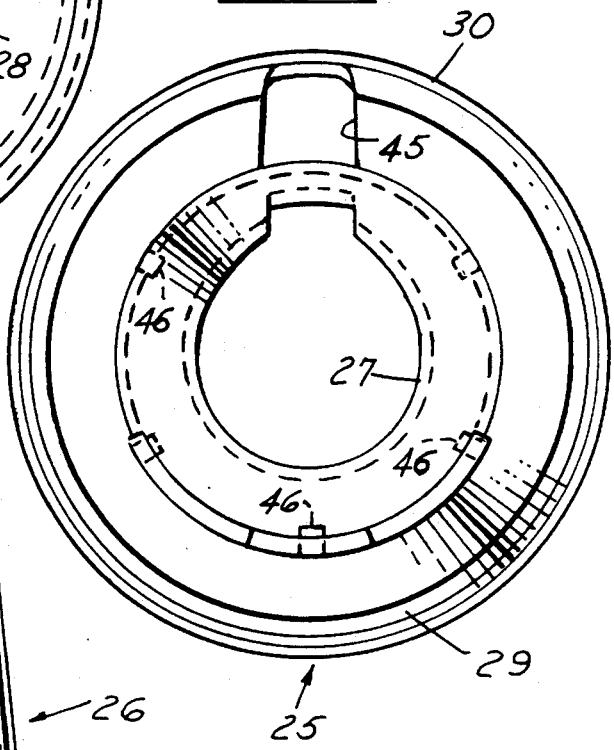
FIG. 2 is a bottom plan view of the fitment in the package.
Figure 4:
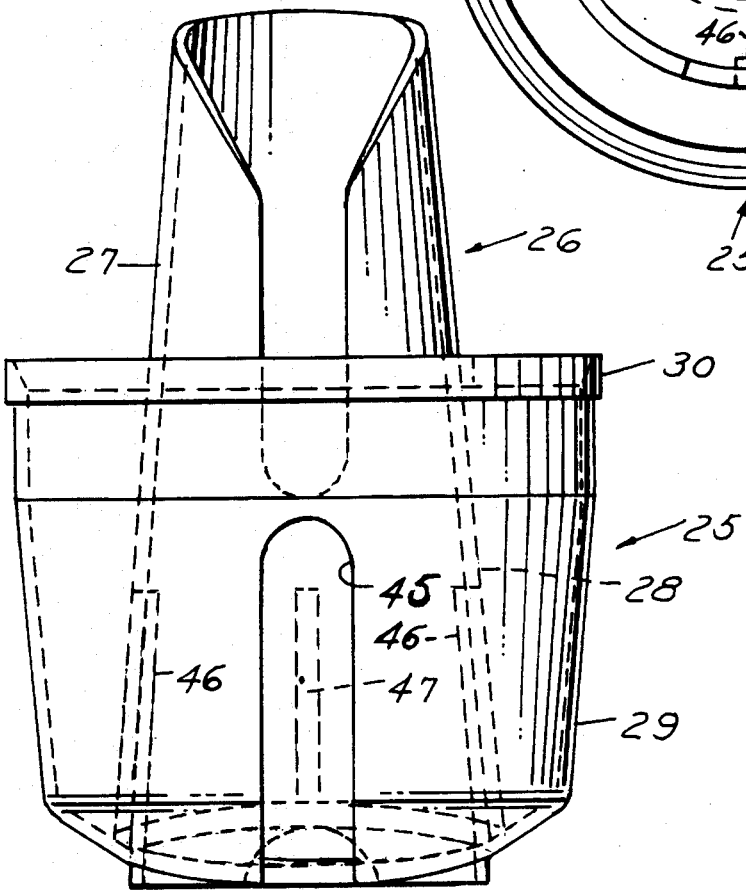
FIG. 4 is a front elevational view of the fitment as viewed from the right in FIG. 1.
Figure 6:
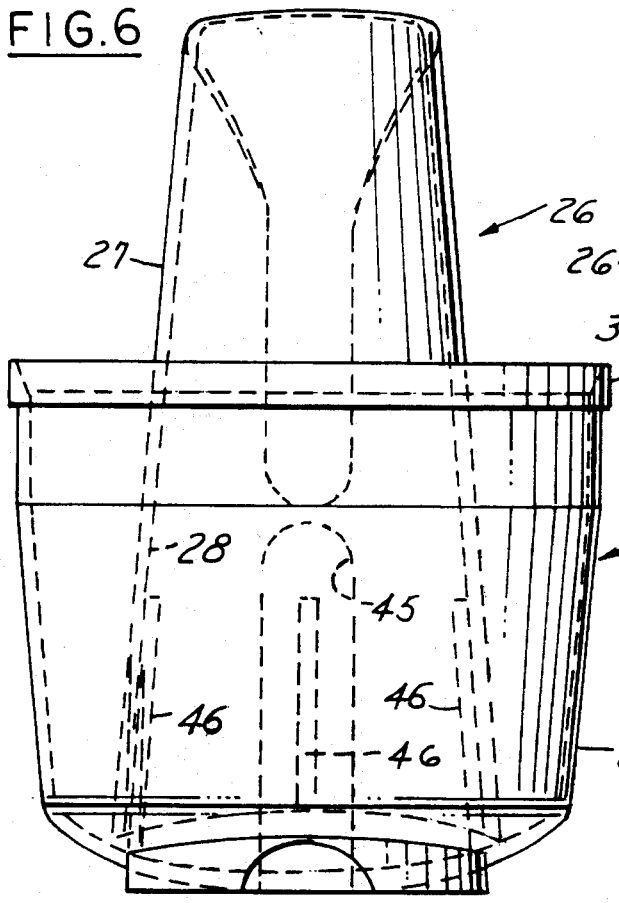
FIG. 6 is an elevational view of the fitment as viewed from the left in FIG. 1.
Figure 8:
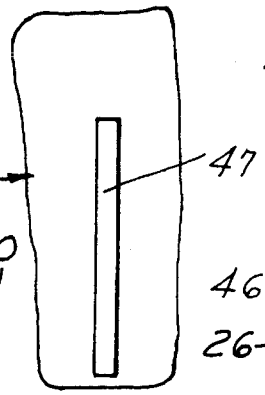
FIG. 8 is a fragmentary sectional view taken along the line 8—8 in FIG. 1.
Figure 9:
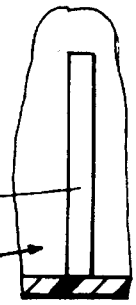
FIG. 9 is a fragmentary sectional view taken along the line 9—9 in FIG. 1.
Figure 10:
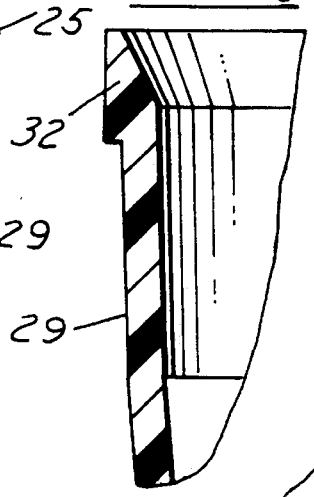
FIG. 10 is a fragmentary sectional view on an enlarged scale of a portion of the upper edge of the fitment.
Figure 7:
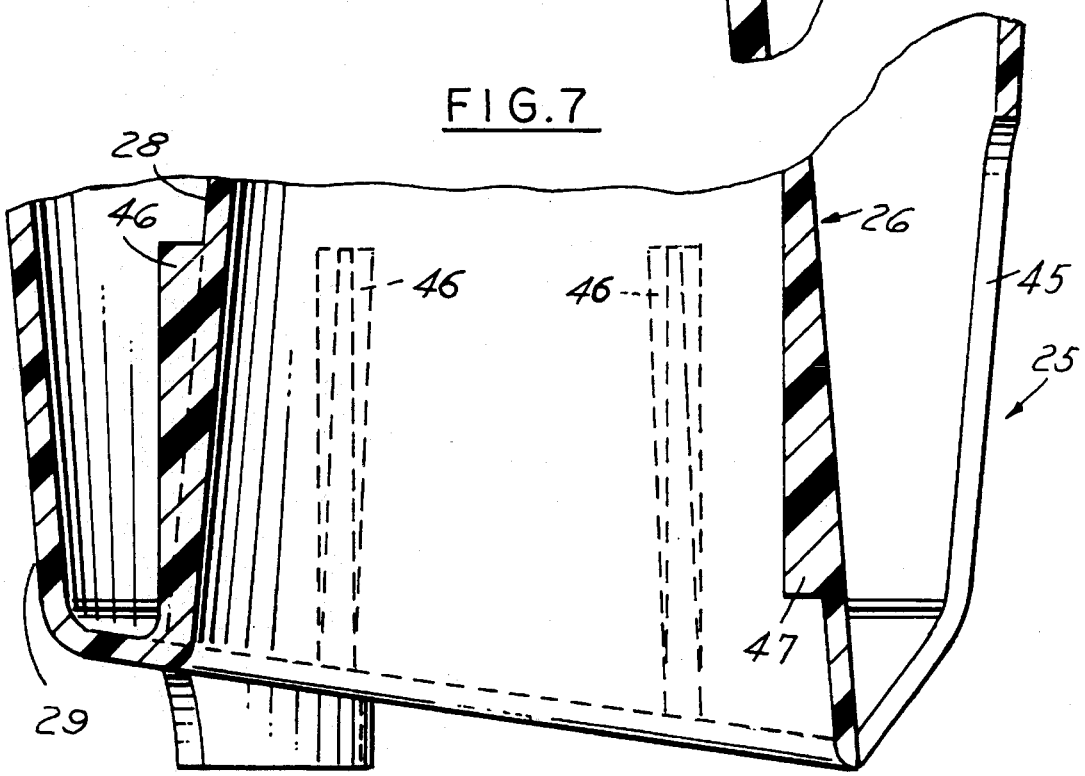
FIG. 7 is a fragmentary view on an enlarged scale of the lower portion of the fitment shown in FIG. 5.

The fitment 25 further includes circumferential spaced vertical ribs 46 on the outer surface of the lower portion 28 (FIGS. 5, 9) and a single vertical rib 47 on the inner surface of the lower portion 28 opposite the opening 45.

The vertical ribs 46 facilitate stacking of the fitments. First, after the parts are manufactured, they are stacked one on top of the other, about twenty (20) high. These stacks are then placed on their side in the shipping cartons, and multiple stacks laid upon each other. This method of packaging greatly improves the efficiency of the cartons. The vertical rib 46 prevents the spouts in stacks from being compressed too much. If the vertical ribs were not included as shown, the parts which have multiple tapered surfaces, could be stacked so tightly together, that the equipment used to pick and place the spouts into the container would malfunction. The function of the rib 47 is utilized with the machinery used to place the spout.

In particular, the single, unsymmetrical rib 43 is used for orienting the spout relative to the container, so that the spout's front pouring edge is placed towards the front container, opposite of the handle of the container.

It can thus be seen that there has been provided a liquid dispensing package wherein the spout fitment or insert has improved mold ability in larger size spouts; which inquires less complicated tooling such that is easier to mold.

What is claimed is:

1. A liquid dispensing fitment for use on a container having a neck comprising a plastic body, said body having an inner wall defining an axial spout extending from within the neck of a container and axially beyond the end of the neck, said body having an outer annular wall spaced from said spout and connected to said spout by an integral annular connecting portion, said spout extending axially beyond said outer wall, said spout having an upper generally C-shaped cross section defining an opening and a lower annular cross section, said annular connecting portion being inclined with respect to the axis of the spout and having its lowermost portion aligned with the said opening of said C-shaped portion of said spout, said outer wall having an axial opening extending from a position aligned with the juncture of the C-shaped portion and annular portion of the spout through said annular connecting portion to define a combined drain back opening and a near empty pour out hole, and integral means on said upper end of said outer wall for engaging the neck of a container, said lower portion of said spout being substantially smooth in an axial direction to facilitate drain back, said lower portion of said spout having an inner surface formed with an integral axial rib having an unsymmetrical cross section aligned with said axial opening in said outer wall to facilitate manufacture.

2. The liquid dispensing fitment set forth in claim 1 including a container having a neck having a finish, said fitment being positioned in said finish with said integral means engaging said neck to define a liquid dispensing package.

3. The liquid dispensing package set forth in claim 2 including a closure having means thereon engaging means on said finish of said container.

4. A liquid dispensing package comprising a container having a hollow body and a neck with a finish having an upper surface with external threads and an internal surface, a fitment comprising a plastic body, said body having an inner wall defining an axial spout extending from within the neck of a container and axially beyond the end of the neck, said body having an outer annular wall spaced from said spout and connected to said spout by an integral annular connecting portion, said spout extending axially beyond said outer wall, said spout having an upper portion having a generally C-shaped cross section defining an opening and a lower portion having an annular cross section, said annular connecting portion being inclined with respect to the axis of the spout and having its lowermost portion aligned with the said opening of said C-shaped portion of said spout, said outer wall having an axial opening extending from a position aligned with the juncture of the C-shaped portion and annular portion of the spout through said annular connecting portion at the lowest point of said annular connecting portion to define a combined drain back opening and a near empty pour out hole, said outer annular wall having an upper end and a portion adjacent said upper end, said portion of said outer annular wall adjacent said upper end of said outer annular wall having an outer surface engaging the internal surface of said finish of said container, said axial opening in said outer annular wall extending within said finish beyond said body of said container to said portion engaging said inner surface of said finish such that substantially the entire contents can be dispensed, integral means on said upper end of said outer wall for engaging a portion of the upper surface of the finish adjacent the inner surface of the finish on the neck of a container.

5. The liquid dispensing package set forth in claim 4 wherein said integral means on said upper end of said outer wall comprises an integral flange engaging a portion of the upper surface of said finish adjacent the inner surface of said finish.

6. The liquid dispensing package set forth in claim 5 including a plastic closure, said plastic closure including a top wall and a peripheral wall extending downwardly within the inner wall and outer wall, said closure including an annular wall extending radially outwardly intermediate the ends of said peripheral wall and an annular skirt extending downwardly and having internal threads engaging said external threads on said finish, said annular wall having an integral sealing bead engaging said integral flange on said upper end of said outer wall of said fitment.

* * * * *